252-99 AU 166 EX
3/14/78 OR 4,079,016

United States Patent [19]
Brahm et al.
[11] 4,079,016
[45] Mar. 14, 1978

[54] SOLID COMPOSITIONS FOR WASHING, CLEANING AND BLEACHING AND PROCESSES FOR THEIR MANUFACTURE AND THEIR USE

[75] Inventors: Jacques Brahm, Grimbergen; Nöel Vanlautem; Alain Decamps, both of Brussels; Julien Mulders, Dworp, all of Belgium

[73] Assignee: Solvay & Cie., Brussels, Belgium

[21] Appl. No.: 588,136

[22] Filed: Jun. 19, 1975

[30] Foreign Application Priority Data

Jun. 25, 1974 Luxembourg ..... 70411
Sep. 23, 1974 Luxembourg ..... 70960

[51] Int. Cl.[2] ..... C11D 7/38; C11D 7/18

[52] U.S. Cl. ..... 252/99; 252/89 R; 252/175; 252/181; 252/DIG. 11; 210/52; 210/58; 260/78.3 UA; 260/340.2; 260/343; 260/343.6; 260/539 R

[58] Field of Search ..... 252/89, 99, DIG. 11, 252/181, 175; 210/52, 58; 260/78.3 UA, 343, 340.2, 343.6, 539 R

[56] References Cited

U.S. PATENT DOCUMENTS 3,776,850 12/1973 Pearson et al. ..... 252/89
3,825,498 7/1974 Altenschopfer et al. ..... 252/99
3,853,781 12/1974 Haschke et al. ..... 252/99 X
3,904,685 9/1975 Shahidi et al. ..... 252/89
3,920,570 11/1975 Mulders ..... 252/89 R
3,984,439 10/1976 Vanlautem et al. ..... 260/343.6

FOREIGN PATENT DOCUMENTS 817,679 7/1974 Belgium ..... 252/89

*Primary Examiner*—Mayer Weinblatt
*Attorney, Agent, or Firm*—Spencer & Kaye

[57] ABSTRACT

A solid composition for washing, cleaning and bleaching includes at least one basic compound and a solid polylactone derived from a polymer of an α-hydroxyacrylic acid. The α-hydroxyacrylic acid from which the solid polylactone is derived contains monomeric units of the formula

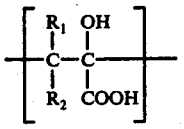

wherein $R_1$ and $R_2$ independently represent hydrogen or an alkyl group containing 1 to 3 carbon atoms.

36 Claims, No Drawings

SOLID COMPOSITIONS FOR WASHING, CLEANING AND BLEACHING AND PROCESSES FOR THEIR MANUFACTURE AND THEIR USE

BACKGROUND OF THE INVENTION

The present invention relates to very efficient solid compositions for washing, cleaning and bleaching as well as to a process for the manufacture of these compositions and a process for their use.

In general, solid compositions containing products of basic character, such as, for example, alkali metal silicates, carbonates, polyphosphates or hydroxides, as well as peroxy-compounds such as alkali metal percarbonates, perborates or peroxides are used for carrying out washing, cleaning and bleaching operations. The choice of the peroxidic compounds is of course restricted to the solid compounds and hitherto it has not been possible to introduce hydrogen peroxide into solid compositions. The solid peroxidic compositions are generally of low activity if the washing treatment is carried out at a relatively low temperature, or if treatments of short duration are used. To overcome this disadvantage, activators are added to these compounds. These activators make it possible to ensure that the above compounds have an acceptable efficiency even at low temperatures. The choice of the activators, however, is limited because a certain number of them have too low a melting point to enable them to be incorporated easily into solid compositions.

In addition to the peroxidic compounds, surface-active agents, which are most frequently anionic surface-active agents, such as alkylarylsulfonates with higher alkyl groups and a single aromatic nucleus, are also added to the washing, cleaning and bleaching compositions. These synthetic detergents, however, lose part of their efficiency in the presence of hard water. Accordingly, the synthetic detergents are used conjointly with one or more detergency auxiliaries, also called "builders", of which one of the principal functions is to sequester the ions responsible for the hardness of the water. The detergency auxiliaries most extensively used at the present time are sodium tripolyphosphate and also sodium nitrilotriacetate. These compounds, however, have the disadvantage of causing eutrophication of lakes and streams into which the effluents containing these compounds are discharged, because of the presence of phosphorus or nitrogen in their molecules.

To reduce the polyphosphate content of the washing, cleaning and bleaching compositions, it has been proposed either to replace the polyphosphates by builders which contain neither phosphorus nor nitrogen, or to replace at least a part of the anionic surface-active agents by non-ionic surface-active agents. Since the non-ionic surface-active agents are less affected by the hardness of the water than the anionic surface-active agents are, it is possible to reduce the phosphate content while increasing the proportion of non-ionic surface-active agent.

An non-ionic surface-active agents, there is currently used the products which owe their solubility in water to the presence of polyether chains, amine-oxide, sulfoxide or phosphine-oxide groups or alkylolamide groups, and, in general, to a substantial number of hydroxyl groups. The most extensively used non-ionic surface-active agents are alcohols with long carbon chains, ethoxylated with ethylene oxide. They generally comprise an alkyl chain of 12 to 18 carbon atoms and an average of 10 to 19 ethylene oxide units.

The main disadvantage of the compositions with a high content of non-ionic surface-active agents manifests itself, however, during their manufacture. The non-ionic surface-active agents which have a sufficiently high detergent power have an ethylene oxide content which is such that they are generally in the form of a viscous liquid or a paste at ambient temperature and are consequently unsuitable for direct addition to the dry detergent powder. Furthermore, it has been established that if too large a quantity, for example more than 5% by weight, of non-ionic surface-active agent is incorporated into the composition before spray-drying, a major problem with respect to the capacity of the drier is encountered. This problem is that these surface-active agents decompose at the temperature usually employed in spray-driers and therefore it is necessary to lower this temperature, and hence the capacity of the drier. Otherwise, dense black smoke escapes from the spray tower, causing severe pollution of the air.

SUMMARY OF THE INVENTION

There has now been found, in accordance with the present invention, a new solid "builder" for solid washing compositions which, when used conjointly with a basic compound, sequesters more efficiently than the other known "builders" the ions responsible for the hardness of water. This new "builder" contains neither phosphorus nor nitrogen and makes it possible to incorporate into the washing compositions relatively very large amounts of products which are not solid, such as activators for peroxidic compounds, non-ionic surface-active agents and hydrogen peroxide.

The present invention, as embodied and broadly described, provides a solid composition for washing, cleaning and bleaching which contains at least one basic compound and a solid polylactone derived from a polymer of an α-hydroxyacrylic acid, containing monomeric units of the formula

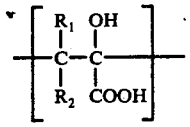

wherein $R_1$ and $R_2$ independently represent hydrogen or an alkyl group containing 1 to 3 carbon atoms.

DETAILED DESCRIPTION OF THE INVENTION

The polylactones used in the practice of the present invention are intermolecular and intramolecular esters of homopolymers or copolymers of α-hydroxyacrylic acids. In these polylactones, about 30 to 100% and in general 40 to 100% of the acid groups of the α-hydroxyacrylic monomeric units are esterified by alcohol groups.

Preferably, polylactones derived from polymers of α-hydroxyacrylic acids in which $R_1$ and $R_2$ represent a hydrogen atom or a methyl group, and $R_1$ and $R_2$ can be identical or different, are used. The best results are obtained with polylactones derived from polymers wherein $R_1$ and $R_2$ represent hydrogen.

The polymers from which the polylactones used in the practice of the present invention are derived are selected from among the homopolymers or copolymers containing units such as have been defined above, of the same type or of several different types. If copolymers are used, they are selected from among those containing at least 50% of units such as those defined above, and preferably from among those which contain at least 65% of similar units. The best results are obtained with polymers which only contain units such as those defined above.

Among the copolymers from which the polylactones used in the practice of the present invention can be derived, are those which contain units derived from vinyl monomers substituted by groups selected from among hydroxyl and carboxyl groups. Advantageously, these copolymers contain acrylic units of the formula $$\text{-}\!\!\left[C(R_3)(R_4)\text{—}CH(COOH)\right]\!\!\text{-}$$

wherein $R_3$ and $R_4$ independently represent a hydrogen atom or an alkyl group containing from 1 to 3 carbon atoms. Among these copolymers, it is preferred to use those containing units derived from unsubstituted acrylic acid, wherein $R_3$ and $R_4$ represent hydrogen.

The polylactone derived from unsubstituted poly-α-hydroxyacrylic acid gives the best result.

The average molecular weight of the polymers of α-hydroxyacrylic acid from which the polylactone used according to the invention is derived, as determined by means of the FLORY equation from the combined results of ultracentrifuging and measurement of the intrinsic viscosity (L. Manderkern and P. J. Flory, *J. Chem. Physics,* 1952, 20, p. 212–214) is greater than about 300 and is advantageously between 5,000 and 1,000,000, and preferably between 10,000 and 600,000.

Regardless of their degree of polymerization and their degree of lactonization, the polylactones used within the scope of the present invention must be solid at ordinary temperature. In contrast, the alkali metal salts or ammonium salts of the corresponding α-hydroxyacrylic acid polymers must be readily soluble in water at ordinary temperature. It is not necessary for the polylactones used according to the invention to be soluble in water. Thus, the polylactone of unsubstituted poly-α-hydroxyacrylic acid, prepared according to Belgian Pat. No. 817,679, filed on July 15th, 1974, in the name of Solvay & Cie. is insoluble in water and is nevertheless particularly suitable for the solid compositions according to the invention. In fact, it has been found, surprisingly, that when the solid composition containing a basic compound and the polylactone of the α-hydroxyacrylic acid polymer is brought into contact with water, the polylactone hydrolyzes instantaneously to give the corresponding salt of the α-hydroxyacrylic acid polymer, which is soluble in water.

The polylactones which can be used according to the present invention can be prepared by any method which is in itself known. By way of a non-limiting example, the method may be based on the processes described by C. S. Marvel et al., *J. Am. Chem. Soc.,* 1940, 62, p. 3495–3498; by L. M. Minsk and W. O. Kenyon, *J. Am. Chem. Soc.,* 1950, 72, p. 2650–2654; or in Belgian Pat. No. 817,679 filed on July 15th, 1974.

The washing compositions according to the present invention also contain a basic compound. As used herein, the term "basic compound(s)" indicates all water-soluble compounds which impart an alkaline pH to water.

The basic compounds can advantageously be selected from among ammonium or alkali metal (such as sodium or potassium) silicates, phosphates, carbonates, borates or hydroxides, or the peroxidic derivatives such as ammonium or alkali metal (such as sodium or potassium) perborates, percarbonates, perphosphates or peroxides. Of course, other derivatives of basic character can also be used. Sodium percarbonate and sodium perborate have proved particularly valuable in the compositions according to the present invention. In fact, compositions containing sodium percarbonate or sodium perborate mixed with the polylactone according to the present invention have proved even more efficient for washing than the conventional compositions respectively containing sodium percarbonate or sodium perborate, because the new compositions in particular make it possible further to reduce the degree of encrustation of dirt in fabrics.

The amount of basic compound introduced into the solid composition is generally greater than 0.05 mol per 100 g of polylactone and is preferably between 0.1 and 20 mols per 100 g of polylactone. Other quantities may also be suitable for particular applications. For example, the use of very large amounts of basic compound may be indicated depending on the application. It is also possible to employ several different basic coumpounds in a single solid composition.

The total amount of the mixture of basic compound and polylactone in the solid composition can vary greatly. It depends on the particular use to which the composition is to be put. The total amount of the mixture of basic compound and polylactone in the solid composition most frequently is in excess of 1% by weight of the total weight of the composition, and preferably in excess of 3% by weight of the total weight of the composition. The solid composition may also contain only the basic compound and the polylactone. Generally the amount of the mixture of basic compound and the polylactone is less than 95% by weight of the total weight of the composition.

The mixture of basic compound and polylactone, according to the present invention, has good sequestering properties. These sequestering properties have been confirmed for metal ions in general and particularly for ions which determine the hardness of water, that is to say, principally the calcium ion and the magnesium ion. In addition, the polylactone used in the mixture has the advantage that it contains neither nitrogen nor phosphorus in the molecule. Thus, the elements most prone to cause eutrophication of algae are absent.

Furthermore, this mixture has the advantage of imparting other, very valuable, properties to the compositions, such as good anti-(soil redeposition) power.

The compositions according to the present invention can also contain other substances selected in accordance with the special field of application of the composition. Among these, there may be mentioned the peroxidic compounds other than those indicated above, such as, for example, hydrogen peroxide, cationic, anionic, non-ionic, amphoteric or ampholytic surface-active agents, activators for per-salts, optical bleaching agents, anti-foaming agents, enzymes, fading inhibitors and anti-(soil redeposition) agents, disinfectants, corrosion inhibitors, perfumes, dyestuffs, pH-regulating agents, agents capable of liberating active chlorine and the like. Furthermore, these compositions can also contain supplementary builders such as, in particular, sodium tripolyphosphate, sodium nitrilotri-acetate or any other known builder. These supplementary builders, however, must normally be used in smaller amounts than those used in the conventional compositions. The simultaneous use of the mixture of basic compound and polylactone and of sodium tripolyphosphate has proved very valuable.

Among the anionic surface-active agents which can be incorporated into the compositions of the present invention, there are especially the sulfonates and sulfates, such as the alkylarylsulfonates, such as dodecylbenzenesulfonate, the alkylethylsulfonates, the alkenylsulfonates, the alkylsulfonates, the alkyl-sulfates, the esters of α-sulfo-fatty acids, the alcohol-sulfates and sulfates of ethoxylated amides, and the like. Other suitable anionic surface-active agents are the alkali metal soaps of fatty acids of natural or synthetic origin. The anionic surface-active agents can be either in the form of sodium, potassium or ammonium salts or in the form of salts of organic bases such as monoethanolamine, diethanolamine or triethanolamine.

As examples of cationic surface-active agents, there may in particular be mentioned octadecylamine hydrochloride as well as other derivatives of the quaternary ammonium type of amines with long linear chains containing from 8 to 18 carbon atoms.

The ampholytic and amphoteric surface-active agents can comprise derivatives such as 3-(N,N-dimethyl-N-hexadecylammonio)propane-1-sulfonate or 3-(N,N-dimethyl-N-hexadecylammonio)2-hydroxypropane-1-sulfonate, the alkylsulfobetaines, the amidoalkenesulfonates, and aliphatic amines substituted by a carboxyl, sulfo, phosphato or phosphino group, and the like.

Numerous non-ionic surface-active agents can also be used, such as the condensates of ethers of polyols with longchain alcohols, with fatty acids and with alkylphenols, which can contain from 3 to 30 glycol ether groups and from 8 to 20 carbon atoms in the alkyl chain; the products of the addition reaction of ethylene oxide with polypropylene glycol; the amine oxides and the sulfoxides which contain at least one $C_{10}$–$C_{20}$ radical and are optionally ethoxylated; and the condensates of alkylene oxides with amines or amides.

This list of surface-active agents is given by way of example. Obviously, other surface-active agents than those indicated above can also prove suitable, such as those quoted in the book by A. M. Schwarz and J. W. Perry *Surface-Active Agents,* or in the U.S. Pat. No. 3,159,581. Either a single type of surface-active agent or mixtures of surface-active agents can be used in the composition which forms the subject of the present invention.

The compositions according to the invention can also contain activators for per-salts such as, for example, anhydrides of organic acids, such as succinic acid, phthalic acid, adipic acid, maleic acid, chlorobenzoic acid, glutaric acid, acetic acid and isophthalic acid; aryl esters of aliphatic acids possessing electronegative substituents on the phenyl nucleus, such as sodium p-acetoxybenzenesulfonate, acetylsalicylic acid, chloroacetylsalicylic acid, sodium p-butyroxybenzenesulfonate, p-acetoxybenzoic acid, potassium chloroacetylphenol-4-sulfonate and 3,4,5-trichloroacetylgallic acid; derivatives containing one or more nitrogen atoms and two acyl groups attached to the same nitrogen atom such as N,N-diacetylaniline, tetraacetylethylenediamine, tri- and tetra-acetylmethylenediamine, tri- and tetra-acetyl hydrazine, tripropionylhydrazine, N,N-diacetyl-N'-benzoylhydrazine, tetraacetylhexamethylenediamine, N,N-diacetyl-p-toluidine, N,N-diacetyl-p-chloroaniline, N,N-dibutyrylaniline and N,N,O-triacetylhydroxylamine; the acyl derivatives of 2,4,6-trihydroxy-1,3,5-triazine, such as diacetylcyanurate and triacetylcyanurate, tripropionylcyanurate and dicylohexanoylcyanurate; acetylated dimethylglyoxime; benzoylimidazole, and azolinone compounds such as those described in U.S. Pat. No. 3,775,333 filed on June 30th, 1972 in the name of American Cyanamid.

Other activators of per-salts can also prove suitable.

Enzymes which can be used are, for example, enzymes from the category of the proteases, lipases and amylases.

Examples of fading inhibitors and anti-(soil redeposition) agents which can be used in the composition of the present invention are benzotriazole or ethylenethiourea and carboxymethylcellulose or polyvinylpyrrolidone.

The soluble sodium silicates and potassium silicates can be used, inter alia, as corrosion inhibitors.

Agents capable of liberating active chlorine which can be used in the composition of the present invention include the chlorinated trisodium phosphates, organic N-chloro-compounds such as sodium dichloroisocyanurate, trichloroisocyanuric acid, N-chlorobenzenesulfonamides or N-chlorotoluenesulfonamides and the like.

Where the additives which it is desired to incorporate into a solid composition according to the invention are liquid or pasty at a temperature below 180° C, they can nevertheless very easily be added to the composition. In fact, the polylactones used can absorb up to about 150% of their weight of a liquid or pasty product. This is a particularly important additional advantage of the compositions according to the present invention because it is possible to add thereto up to 150% of the weight of the polylactone and preferably from 10 to 140% of the weight of the polylactone, of a liquid or pasty adjuvant.

This advantage proves decisive if it is desired to incorporate into a solid washing composition, a surface-active agent which is in a liquid or pasty form preferably a non-ionic surface-active agent. In fact, it should be recalled that these latter agents have the advantage of being less sensitive to water hardness, which makes it possible to use smaller quantities of sequestering agents. The use of non-ionic surface-active agents in solid compositions, however, had hitherto been hindered by the fact that they are liquid or pasty at temperatures below 180° C. The present invention makes it possible to overcome this obstacle. Thus, non-ionic surface-active agents such as, for example, ethoxylated derivatives, can advantageously be adsorbed on the polylactone which forms part of the composition according to the present invention.

The high adsorption capacity of the polylactone also makes it possible to introduce activators for per-salts, which activators are liquid or pasty at temperatures below 180° C. This now makes it possible to consider the use of a much broader range of activators for per-salts in solid washing compositions. The polylactones according to the invention are notably particularly suitable as carriers for N,N,O-triacetylhydroxylamine. Since this activator is liquid at ordinary temperature it cannot easily be incorporated into solid washing compositions. It has been found that due to the polylactones used according to the present invention, large quantities of this liquid activator can be introduced into the solid washing compositions by adsorbing the liquid activator on the said polylactone at the rate of 10 to 150% of the weight of the latter.

The polylactone furthermore has the advantage that it can also adsorb large quantities of hydrogen peroxide. To produce such compositions, it is advantageous to use hydrogen peroxide as an aqueous solution of 10–70%, and preferably about 30%, strength by weight. The solutions of hydrogen peroxide are absorbed generally at the rate of 10 to 150% of the weight of the polylactone.

The direct introduction of hydrogen peroxide into the compositions of the present invention makes it possible to dispense with, or reduce, the addition of per-salts (perborates, percarbonates and the like) which are usually employed to obtain solid compositions possessing oxidizing capacity, and which have to be synthesized from hydrogen peroxide.

Of course, different liquid or pasty adjuvants can simultaneously be adsorbed on the polylactone. In that case, the total quantity of adjuvants adsorbed should not exceed 150% of the weight of the polylactone. Thus, for example, an aqueous solution of hydrogen peroxide and a non-ionic surface-active agent can be adsorbed simultaneously on the polylactone. In that case, polylactone granules having a relatively high active oxygen content and increased stability during storage are obtained.

The present invention also relates to the use of the solid compositions defined above for washing and bleaching textiles and fibers, in dish-washing machines, for cleaning of equipment, tanks, pipelines and surfaces of all kinds, regardless of whether intended for industrial or domestic uses, such as, for example, fine hand laundering or machine laundering, high temperature laundering in drum-type machines, prewashing, cleaning of ceramic, glass, metal, plastic and wooden surfaces, bleaching of cellulosic materials (paper pulp or wood), bleaching of oils and fats and the like.

The temperature at which the compositions according to the present invention can be used is generally between 0° and 130° C. In general, temperatures of between 20° and 105° C are used. The temperature depends on the nature of the article which it is desired to wash, clean or bleach and on the technique used.

A typical composition which can be used for bleaching in particular contains, by weight, from 10 to 95% of one or more peroxidic compounds, from 0 to 60% of one or more activators of peroxidic compounds, from 0.1 to 80% of polylactone, optionally mixed with a known builder, from 0 to 50% of a surface-active agent and from 0 to 50% of a basic compound, the presence of which is essential if the peroxidic compound is not of basic character.

Such compositions are used at the rate of 0.5 to 20 g per liter of water and the use temperatures vary between 20° and 130° C, while the bleaching time can vary between 1 and 200 minutes.

These compositions can contain a solid peroxidic compound such as the percarbonates, perborates and the like, or an aqueous solution of hydrogen peroxide which, in that case, is adsorbed on the polylactone, or the two types of compounds simultaneously.

For washing, one uses, for example, a composition which can in particular contain, by weight, from 1 to 60% of surface-active agent, from 1 to 90% of polylactone optionally mixed with other known builders, from 5 to 50% of one or more compounds of basic character which can optionally be peroxidic compounds and from 0 to 60% of one or more activators of peroxidic compounds.

Such compositions are used at the rate of 0.5 to 20 g per liter of water at temperatures between 10° and 110° C and for periods which can range from 2 to 100 minutes.

The compositions for use in dish-washing machines can, for example, contain by weight, in particular from 1 to 60% of polylactone optionally mixed with a known builder, from 1 to 50% of a soluble alkali metal silicate, from 0.2 to 70% of a basic compound, from 0 to 10% of a compound which liberates active chlorine and from 0 to 20% of a surface-active agent.

Such compositions are used at the rate of 0.5 to 15 to g per liter of water at temperatures between 20° and 80° C for periods which can range from 1 to 100 minutes.

A typical composition which can be used for scouring in particular contains, by weight, from 1 to 20% of surface-active agent, from 0.1 to 25% of polylactone optionally mixed with a known builder, from 40 to 95% of abrasive, from 0.1 to 20% of basic compound and from 0 to 10% of a compound capable of liberating active chlorine.

The cleaning of surfaces of equipment contaminated by organic or inorganic impurities and used especially in the foodstuff industries can be carried out at temperatures between 20° and 90° C for periods of 2 to 120 minutes, and using from 1 to 100 g, per liter of water, of a composition which in particular contains, by weight, from 1 to 40% of an alkali metal hydroxide, from 3 to 70% of polylactone optionally mixed with another, known, builder, from 0.1 to 30% of alkali metal silicate, from 0.1 to 15% of surface-active agent and from 0 to 30% of tripolyphosphate.

The above examples of compositions are of course given by way of example and without implying a limitation. Other compositions containing the two constituents according to the present invention can also be used.

The present invention furthermore relates to a process for the manufacture of the solid compositions defined above. These compositions can be prepared according to any technique which is in itself known, by mixing, granulation or spray-drying.

The polylactone granules can be obtained by conventional methods. For example, the polymer can be compacted and then crushed and sieved, or can be granulated, particularly in a granulating extruder or in a mixer, and then crushed and sieved. These granulating processes can be carried out in the presence of a binder such as water.

If it is desired to use a liquid or pasty adjuvant in the composition, the adjuvant is incorporated into the polylactone granules in a manner which is in itself known, for example by simple mixing, if appropriate at elevated temperatures, so as to render the adjuvant more fluid. It is also possible to mix the liquid adjuvant with the polylactone in the form of a fine powder in the presence of a binder and then to granulate and dry the mixture obtained.

The polylactone granules, optionally impregnated with liquid adjuvant, can be coated to increase their mechanical strength. This coating can in particular be caried out in a fluidized bed.

When preparing the polylactone granules, attention should be given to their apparent density and their sizes being close to those of the other constituents of the composition so that no separation should occur in the finished product during storage. The average diameter of the granules is preferably between 0.1 and 1.5 mm.

As has been stated above, it is essential that the polylactones used within the scope of the present invention should be mixed with a basic compound. In fact, if the compositions do not contain such a compound, the polylactone is incapable of performing its function as a builder in sequestering the ions responsible for water hardness.

It has been found, surprisingly, that the compositions containing the mixture of polylactone and basic compound which forms the subject of the present invention are more efficient if they are added directly, in the solid state, to the washing, cleaning or bleaching medium, than are similar compositions wherein the polylactone is replaced by a corresponding amount of the poly-α-hydroxyacrylate corresponding to the hydrolysis of the polylactones.

In order better to demonstrate the remarkable results obtained according to the process of the invention, we give some test results below, by way of examples.

EXAMPLE 1

The object of this example is to compare the washing efficiency of two compositions containing a basic compound and the polylactone according to the present invention (Powder A1 and Powder A2) with that of two similar compositions Ref. 1 and Ref. 2) in which the polylactone is replaced by a known builder, namely sodium poly-α-hydroxyacrylate.

The washing tests were carried out in a Terg-Otometer laboratory washing machine manufactured by US Testing Co., Hoboken (USA), using washing powders having the composition shown in Table I below.

| | |
|---|---|
| Temperature : | 60° C |
| Duration : | 10 minutes |
| Speed of agitation : | 80 strokes per minute |
| Water employed : | hardness 15 degrees (French scale)<br>Ca/Mg ratio : 4:1<br>volume : 1 liter |
| Washing powder introduced : | 2 g/l |
| Samples of fabric to be washed : | 5 stained pieces of the same type<br>5 unsoiled pieces of the same fabric as the stained pieces |
| Weight of fabric/weight of solution: | 1/50. |

The samples of fabric to be washed are soiled by means of lampblack and a fatty material. Different types of samples were used, namely cotton samples produced respectively by EMPA (Switzerland) (cotton 1), WFK Krefeld (RFA) (cotton 2) and TEST FABRICS (USA) (cotton 3), as well as polyester-cotton, polyamide and cellulose acetate samples produced by TEST FABRICS (USA).

The samples of fabric to be washed are introduced into the washing machine less than 5 minutes after introducing the washing powder.

The effect of the washing treatment on the various samples is measured by the variation in their whiteness. The whiteness is measured by means of an RFC 3 (Zeiss) reflectometer equipped with a green trichromatic filter standarized by CIE (Commission Internationale de l'Eclairage). The values obtained for the reflectances are quoted in terms of absolute reflectance.

For each stained sample, the degree of removal of soil, in %, that is to say the ratio $$\frac{\text{soil removed}}{\text{soil to be removed}} \times 100$$

is given by the equation:

$$\frac{\text{reflectance after washing} - \text{reflectance before washing}}{\text{initial reflectance (before staining)} - \text{reflectance after washing}} \times 100$$

The degree of soil removal is equal to the arithmetic mean of the preceding results for all the samples of a given type. The mean degree of soil removal for all the types of samples is in turn equal to the arithmetic mean of the degrees of removal of each type of soil. The overall results are shown in Table I below.

Table I

| | Powder A1 according to the invention | Reference powder Ref. 1 | Powder A2 according to the invention | Reference powder Ref. 2 |
|---|---|---|---|---|
| Composition of the powder, % by weight: | | | | |
| hydrogenated tallow soap | 3 | 3 | 3 | 3 |
| anionic surface-active agent LAS DOBANE JN (dodecylbenzenesulfonate) sold by Shell | 2.5 | 2.5 | 2 | 2 |
| non-ionic surface-active agents | | | | |
| ethoxylated ALFOL (long-chain alcohol) sold by Continental Oil Co. | | | | |
| $C_{16}$-$C_{18}$ cut ethoxylated with 50 mols of ethylene oxide | 6 | 6 | 0 | 0 |
| $C_{10}$-$C_{12}$ cut ethoxylated with 5 mols of ethylene oxide | 0.5 | 0.5 | 6 | 6 |
| sodium silicate | 10.5 | 10.5 | 10.5 | 10.5 |
| sodium percarbonate (13.8% of active oxygen) | 14.5 | 14.5 | 14.5 | 14.5 |
| polylactone derived from poly-α-hydroxyacrylic acid (mean molecular weight 40,000), 90% solids content | 13.9 | — | 11 | — |
| sodium poly-α-hydroxyacrylate | — | 21.8 | — | 17.3 |
| anhydrous sodium sulfate | 37.4 | 41.2 | 45.7 | 46.7 |
| sodium carbonate | 11.7 | — | 7.3 | — |
| Mean degree of soil removal, % | 22.6 | 19.7 | 22.6 | 19.9 |

Examination of Table I shows that the polylactone proves to be a very efficient builder at very low concentrations.

Furthermore, if account is taken of the fact that powders A1 and A2 give the same concentrations of poly-α-hydroxylate after hydrolysis as those shown respectively in reference powders Ref. 1 and Ref. 2, it is noted that the powders containing the polylactone make it possible to achieve a higher average degree of soil removal.

EXAMPLE 2

The object of this example is to compare the washing efficiency of a composition in which all or part of the sodium tripolyphosphate is replaced by the polylactone derived from poly-α-hydroxyacrylic acid, according to the invention, with that of the corresponding commercially available powder which only contains sodium tripolyphosphate.

The washing experiments were carried out under the same conditions as those recorded for Example 1. The polylactone content of all the compositions recorded in Table II below was adjusted to give an identical means degree of soil removal (as defined for Example 1) for all the tests.

Table II

| | Powder A 1 according to the invention | Powder A 10 according to the invention | Powder A 3 according to the invention | Powder A 4 according to the invention | Reference powder Ref. 3 | Powder A 5 according to the invention | Reference powder Ref. 4 |
|---|---|---|---|---|---|---|---|
| Composition of the powder, % by weight | | | | | | | |
| hydrogenated tallow soap | 3 | 3 | 3 | 3 | 3 | 3 | 3 |
| anionic surface-active agent LAS DOBANE UN (dodecylbenzenesulfonate) | 2.5 | 2.5 | 2.5 | 2.5 | 2.5 | 2.5 | 2.5 |
| non-ionic surface-active agents | | | | | | | |
| ethoxylated ALFOL (longchain alcohol) $C_{16}$–$C_{18}$ cut ethoxylated with 50 mols of ethylene oxide | 6 | 6 | 6 | 6 | 6 | 6 | 6 |
| $C_{10}$–$C_{12}$ cut ethoxylated with 5 mols of ethylene oxide | 0.5 | 0.5 | 0.5 | 0.5 | 0.5 | 0.5 | 0.5 |
| sodium silicate | 10.5 | 10.5 | 10.5 | 10.5 | 10.5 | 10.5 | 10.5 |
| sodium percarbonate (13.8% of active oxygen) | 14.5 | 14.5 | 14.5 | 14.5 | 14.5 | 0 | 0 |
| sodium perborate (10% of active oxygen) | 0 | 0 | 0 | 0 | 0 | 20 | 20 |
| polylactone derived from poly-α-hydroxy-acrylic acid (mean molecular weight 40,000), 90% solids content | 13.9 | 12.8 | 9 | 2.5 | 0 | 13.9 | 0 |
| sodium tripolyphosphate (STPP) | 0 | 2 | 8.5 | 30 | 40 | 0 | 40 |
| anhydrous sodium sulphate | 37.4 | 38.2 | 41.2 | 30.5 | 23 | 22.6 | 8.2 |
| sodium carbonate | 11.7 | 10 | 4.3 | 0 | 0 | 21 | 9.3 |
| Mean degree of soil removal, % | 22.6 | 22.6 | 22.6 | 22.6 | 22.6 | 22.6 | 22.6 |

Examination of the results given in Table II shows that to obtain an identical detergency effect, it is possible to use lower amounts of polylactone than the amounts of sodium tripolyphosphate.

Furthermore, comparison of the tests carrid out with powders A1 and A4 shows that the polylactone is particularly efficient at low concentrations. In fact, to achieve identical detergency, 10 g of STPP were replaced by 2.5 g of polylactone in powder A4, implying that the efficiency of the polylactone is 4 times as great as that of the STPP, while in powder A1, 40 g of STPP were replaced by 13.9 g of polyactone, implying that the efficiency of the polylactone is 2.9 times as great.

EXAMPLE 3

This example shows the adsorption capacity of the polylactone for a liquid adjuvant. The liquid adjuvant used is a non-ionic surface-active agent, DOBANOL 45-11 (longchain alcohol) consisting of a $C_{14}$–$C_{15}$ cut ethoxylated with 11 molecules of ethylene oxide sold by Shell.

Granules of the polylactone derived from poly-α-hydroxyacrylic acid (molecular weight ranging from 35,000 to 700,000) of diameter between 0.50–0.84 mm were used.

The following process was used to fix the surface-active agent.

The surface-active agent is introduced into a mixer thermostatically controlled to 50° C. After melting the surface-active agent, the polylactone is introduced and mixing is carried out for 5 minutes at 50° C. The mixture is cooled to 25° C and a sample is taken, on which the caking and the apparent specific gravity are measured.

The apparatus used to measure the caking consists of a cylindrical cell made of copper or stainless steel, 29.8 mm in diameter and 170 mm high, provided with a piston at one end and a 10 mm thick plug at the other end. 50 g of product are weighed out and sieved for 5 minutes on an 0.841 mm vibrating sieve. The amount of product rejected ($r_1$) and the amount of product which has passed through the sieve ($P_1$) are measured. The initial sample of 50 g is reconstituted and introduced into the cell. The cell is closed by means of the piston, on which an additional weight has been placed so as to give a pressure of 0.35 kg/cm². The whole is left in a ventilated oven for 17 hours at 42° C. The cell is then emptied, the material is sieved for five minutes on the same 0.841 mm vibrating sieve and the rejected material ($r_2$) and the amount which has passed through the sieve ($P_2$) are measured. The caking in % is given by the following equation:

$$\frac{r_2}{r_2 + P_2} \times 100 - \frac{r_1}{r_1 + P_1} \times 100$$

The apparent specific gravity under free flow is determined by a process analogous to that described in A.S.T.M. Standards D 392–38 and B 212–48, respectively, proposed for measuring the apparent specific gravity of molding powders and of metal powders. The apparatus used is, however, slightly different. It possesses a hopper in the shape of a truncated cone, of which the large base has a diameter of 53 mm and the small base, equipped with a shut-off which can be opened completely, has a diameter of 21 mm, the height between the bases being 58 mm and the useful volume being about 60 cm³.

The cylindrical cell, of 50 cm³ volume, has an internal diameter of 37 mm and a height of about 46 mm. The base of the hopper is placed 65 mm above the bottom of the cell. The working method is identical to that described in the A.S.T.M. standards. The hopper shut-off is closed and the hopper is filled with the product to be examined and smoothed off to the level of the upper edge of the hopper by means of a straight-edge. The cell is arranged in line with the axis of the hopper and the shut-off is opened. After the material has flowed out, it is smoothed off to the upper level of the cell. The apparent specific gravity under free flow is equal to the ratio of the weight of material in the cell, expressed in kg, and the volume of the cell expressed in $dm^3$.

The results, as a function of the varying amount of surface-active agent for a given weight of polyactone, are given in Table III below.

Table III

| DOBANOL 45-11 g | Poly-lactone g | Flow | Caking | Apparent specific gravity, kg/$dm^3$ |
|---|---|---|---|---|
| 75 | 75 | very good | 0.1 | 0.48 |
| 93.75 | 75 | very good | — | — |
| 112.50 | 75 | lump formation | not measurable | — |

The polylactone impregnated with surface-active agent is easy to granulate. The granules obtained exhibit good flow and the color of the product is unimpaired.

EXAMPLE No. 4

This example shows the washing efficiency of a composition of materials suitable for use in washing, in which all or part of the tripolyphosphate of reference powder Ref. 3 (described in Table II of Example 2 above) has been replaced by the polylactone used as the carrier for the non-ionic surface-active agent, in accordance with Example 3 described above and on which non-ionic surface-active agent DOBANOL 45-11 is adsorbed.

The washing was carried out under the same conditions as those given in Example No. 1 and the working method was identical except for the fact that the washing solution was prepared a certain time before the introduction of the soiled fabric samples. Table IV below shows the compositions of the various washing powders used and Table V below summarizes the results that were obtained.

Table IV

| Powder | Ref. 3 | A 6 | A 7 | A 8 | A 9 |
|---|---|---|---|---|---|
| | % by weight | | | | |
| hydrogenated tallow soap | 3 | 3 | 3 | 3 | 3 |
| anionic surface-active agent LAS DOBANE JN (dodecylbenzenesulfonate) | 2.5 | 2.5 | 2.5 | 2.5 | 2.5 |
| non-ionic surface-active agents | | | | | |
| ethoxylated ALFOL (longchain alcohol) | | | | | |
| $C_{16}$-$C_{18}$ cut ethoxylated with 50 mols of ethylene oxide | 6 | 6 | 6 | 6 | 6 |
| $C_{10}$-$C_{12}$ cut ethoxylated with 5 mols of ethylene oxide | 0.5 | 0.5 | 0.5 | 0.5 | 0.5 |
| DOBANOL 45-11 (longchain alcohol) | | | | | |
| $C_{14}$-$C_{15}$ cut ethoxylated with 11 mols of ethylene oxide | — | 7 | 7 | 7 | 7 |
| sodium silicate | 10.5 | 10.5 | 10.5 | 10.5 | 10.5 |
| sodium percarbonate (13.8% of active oxygen) | 14.5 | 14.5 | 14.5 | 14.5 | 14.5 |
| polylactone derived from poly-α-hydroxyacrylic acid (molecular weight ranging from 35,000 to 700,000) | — | 7 | 7 | 7 | 7 |
| sodium tripolyphospate (STPP) | 40 | 22 | 12 | 2 | — |
| anhydrous sodium sulphate | 23 | 27 | 37 | 47 | 49 |

Table V

| Powder | STPP % | Poly-lactone % | DOBANOL % | Degree of soil removal, % | | | | | |
|---|---|---|---|---|---|---|---|---|---|
| | | | | Cotton 1 | Cotton 2 | Cotton 3 | Polyester-cotton | Polyamide | Cellulose acetate |
| Ref.3 | 40 | — | — | 32.7 | 57.4 | 15.1 | 12.5 | 39.2 | 20.1 |
| A 6 | 22 | 7 | 7 | 33.8 | 61.4 | 14.7 | 15.1 | 46.7 | 21.0 |
| A 7 | 12 | 7 | 7 | 27.6 | 54.5 | 15.2 | 13.9 | 33.1 | 19.8 |
| A 8 | 2 | 7 | 7 | 18.8 | 41.2 | 14.7 | 12.5 | 18.6 | 18.6 |
| A 9 | — | 7 | 7 | 17.6 | 39.7 | 12.9 | 13.0 | 21.8 | 19.1 |

The results of the experiments summarized in the preceding Table V show that the content of sodium tripolyphosphate can be reduced greatly if the polylactone is used, because of the fact that the adsorption properties of the polylactone make it possible to introduce additional amounts of a surface-active agent such as DOBANOL without causing a marked reduction in the degree of soil removal. In certain cases, no reduction in this degree of soil removal is observed even if the STPP is omitted completely (see polyester-cotton).

EXAMPLE 5

This example shows the adsorption capacity of the polylactone for a liquid adjuvant. The liquid compound is a 70% strength by weight aqueous solution of hydrogen peroxide.

A polylactone derived from poly-α-hydroxyacrylic acid of mean molecular weight of about 50,000 was used.

The process used to fix the aqueous hydrogen peroxide solution is as follows.

8 g of dried polylacetone are introduced into 110 $cm^3$ of dry benzene and the mixture is heated under reflux for 2 hours. The mixture is cooled to +10° C and 3.93 g of a 70% strength aqueous solution of hydrogen peroxide are introduced dropwise while stirring at about 1,500 revolutions/minute. The introduction lasts 10 minutes. After filtering, and distilling the benzene in vacuo, the polylacetone impregnated with hydrogen peroxide is obtained.

The active oxygen content after drying is 104 g per kg and the loss of active oxygen after 4 days storage at 32° C and 80% humidity is 1.3%.

It will be understood that the above description of the present invention is susceptible to various modifications changes and adaptations, and the same are intended to be comprehended within the meaning and range of equivalents of the appended claims.

What is claimed is:

1. A solid composition for washing, cleaning and bleaching comprising at least one basic compound which when dissolved in water imparts an alkaline pH to water and a solid polylacetone derived from a polymer of an α-hydroxyacrylic acid, containing monomeric units of the formula

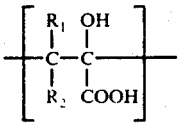

wherein $R_1$ and $R_2$ independently represent hydrogen or an alkyl group containing 1 to 3 carbon atoms.

2. Composition according to claim 1, wherein the polymer is a copolymer containing at least 50 mol % of monomeric units of the formula

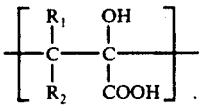

3. Composition according to claim 1, wherein $R_1$ and $R_2$ independently represent hydrogen or the methyl group.

4. Composition according to claim 1, wherein $R_1$ and $R_2$ represent hydrogen.

5. Composition according to claim 1, wherein the molecular weight of the polymer is between 5,000 and 1,000,000.

6. Composition according to claim 1, wherein the polylacetone is an intermolecular and intramolecular ester of a polymer of an α-hydroxyacrylic acid, wherein 30 to 100% of the acid groups of the α-hydroxyacrylic monomer units are esterified by alcohol groups.

7. Composition according to claim 1, wherein the basic compound is sodium percarbonate.

8. Composition according to claim 1, wherein the basic compound is sodium perborate.

9. Composition according to claim 1, in which the basic compound is present in a concentration of more than 0.05 mole per 100 g of polylacetone.

10. Composition according to claim 1, in which the basic compound is present in a concentration of 0.1 to 20 moles per 100 g of polylacetone.

11. Composition according to claim 1, which can be used for bleaching, comprising, by weight, from 10 to 95% of at least one peroxidic compound selected from the solid inorganic persalts and an aqueous solution of hydrogen peroxide, from 0 to 60% of at least one activator for the peroxidic compound, from 0.1 to 80% of polylactone, from 0 to 50% of a surface-active agent, and from 0 to 50% of a basic compound, the presence of which is essential if the peroxidic compound is not of basic character.

12. Composition according to claim 1, for use in dishwashing machines, comprising, by weight, from 1 to 60% of polylacetone, from 1 to 50% of a soluble alkali metal silicate, from 0.2 to 70% of a basic compound, from 0 to 10% of a compound which liberates active chlorine, and from 0 to 20% of a surface-active agent.

13. Composition according to claim 1, which can be used for scouring, comprising, by weight, from 1 to 20% of surface-active agent, from 0.1 to 25% of polylacetone, from 40 to 95% of abrasive, from 0.1 to 20% of a basic compound, and from 0 to 10% of a compound capable of liberating active chlorine.

14. Composition according to claim 1, wherein the basic compound is selected from the group consisting of ammonium or alkali metal perborates, percarbonates, perphosphates and peroxides.

15. Composition according to claim 1, wherein the polymer is a polymer which only contains monomeric units of the formula

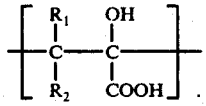

16. Composition according to claim 15, which further contains a hydrogen peroxide adjuvant which is liquid or pasty at temperatures below 180° C and which is adsorbed on the polylactone.

17. Composition according to claim 16, wherein the hydrogen peroxide is adsorbed in the form of an aqueous solution.

18. Composition according to claim 17, wherein the aqueous solution contains from 10 to 70% by weight of hydrogen peroxide.

19. Composition according to claim 1, wherein the basic compound is selected from the group consisting of ammonium or alkali metal silicates, phosphates, carbonates, borates and hydroxides.

20. Composition according to claim 19, wherein the alkali metal is sodium or potassium.

21. Composition according to claim 1, which further contains a surface-active agent.

22. Composition according to claim 21, wherein the surface-active agent is selected from cationic, anionic, non-ionic, amphoteric and ampholytic surface-active agents.

23. Composition according to claim 1, which further contains at least one adjuvant normally present in mixtures generally used for washing, cleaning and bleaching, which adjuvant is liquid or pasty at temperatures below 180° C and is adsorbed on the polylactone.

24. Composition according to claim 23, wherein the amount of adjuvant adsorbed on the polylactone is between 10 and 150% of the weight of polylactone.

25. Composition according to claim 23, wherein the amount of adjuvant adsorbed on the polylactone is between 10 and 140% of the weight of polylactone.

26. Composition according to claim 23, wherein the adjuvant adsorbed is an activator for a per-salt.

27. Composition according to claim 26, wherein the activator is N,N,O-triacetylhydroxylamine.

28. Composition according to claim 23, wherein the adjuvant adsorbed is hydrogen peroxide.

29. Composition according to claim 28, wherein the hydrogen peroxide is adsorbed in the form of an aqueous solution.

30. Composition according to claim 29, wherein the aqueous solution contains from 10 to 70% by weight of hydrogen peroxide.

31. Composition according to claim 23, wherein the adjuvant adsorbed is a surface-active agent.

32. Composition according to claim 31, wherein the surface-active agent is selected from cationic, anionic, non-ionic, amphoteric and ampholytic surface-active agents.

33. Composition according to claim 31, wherein the surface-active agent is a non-ionic surface-active agent.

34. Composition according to claim 33, wherein the surface-active agent is from the condensates of ethers of polyols with longchain alcohols, with fatty acids and with alkylphenols, which can contain from 3 to 30 glycol ether groups and from 8 to 20 carbon atoms in the alkyl chain; the products of the addition reaction of ethylene oxide with polypropylene glycol; the amine oxides and the sulfoxides which contain at least one $C_{10}$-$C_{20}$ radical and are optionally ethoxylated; and the condensates of alkylene oxides with amines or amides.

35. Composition according to claim 1, comprising, by weight, from 1 to 60% of surface-active agent, from 1 to 90% of polyactone, from 5 to 50% of at least one compound of basic character, which basic compound can be a peroxidic compound selected from the solid inorganic persalts and an aqueous solution of hydrogen peroxide, and from 0 to 60% of at least one activator for the peroxidic compound.

36. Composition according to claim 35, wherein the basic compound is a peroxidic compound selected from the solid inorganic persalts and an aqueous solution of hydrogen peroxide.

* * * * *